US005806533A

United States Patent [19]

Boling

[11] Patent Number: 5,806,533

[45] Date of Patent: Sep. 15, 1998

[54] CIGARETTE SNUFFING DEVICE AND METHOD

[76] Inventor: Robert C. Boling, 66 Crystal Springs Rd., Lexington, S.C. 29073

[21] Appl. No.: 855,837

[22] Filed: May 12, 1997

[51] Int. Cl.[6] ..... A24F 13/18

[52] U.S. Cl. ..... 131/256; 131/235.1; 131/231

[58] Field of Search ..... 131/256, 235.1, 131/231, 178; 431/151, 152

[56] References Cited

U.S. PATENT DOCUMENTS 3,291,138 12/1966 Thomson ..... 131/256

FOREIGN PATENT DOCUMENTS 2123100 12/1972 Germany ..... 131/256

*Primary Examiner*—John G. Weiss
*Assistant Examiner*—Charles W. Anderson
*Attorney, Agent, or Firm*—Thomas L. Moses

[57] ABSTRACT

A cigarette and cigar snuffing device comprising a base member defining a centrally located opening therein, and a vertical cylindrical throat member having an opening at an upper portion and an opening at a lower portion, which communicates with the opening in the base member. The upper portion of the throat member defines a pair of opposed grooves for use in securing a cigarette in a horizontal position therein while a smoker is otherwise occupied. The cigarette snuffing device is placed into an ash tray, the lit end of a cigarette is dropped into the opening at the upper portion, through the lower portion opening, further through the opening in the base, and comes into direct contact with the floor of the ash tray. A lack of oxygen quickly and efficiently extinguishes the cigarette.

7 Claims, 1 Drawing Sheet

Fig 1
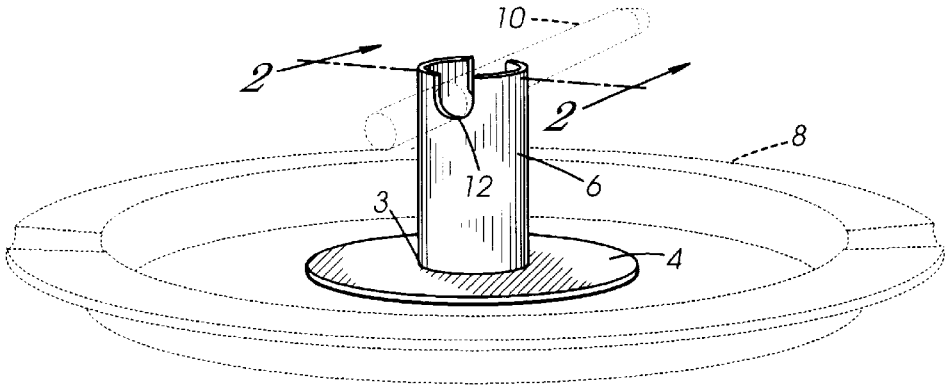
Fig 2
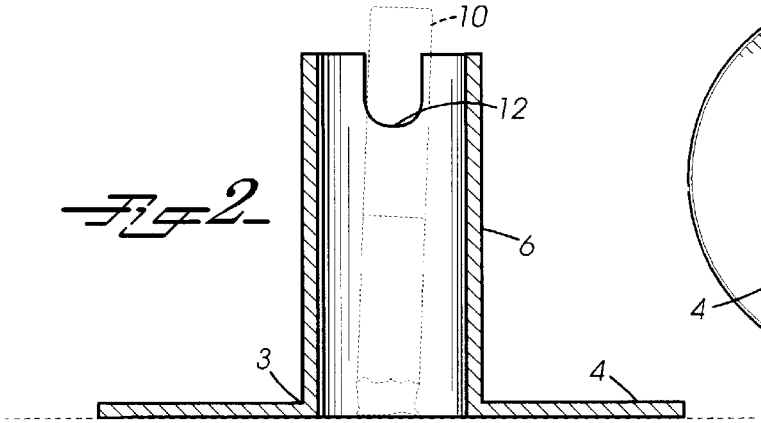
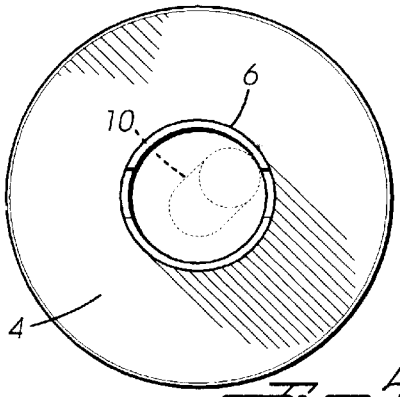
Fig 5
Fig 3
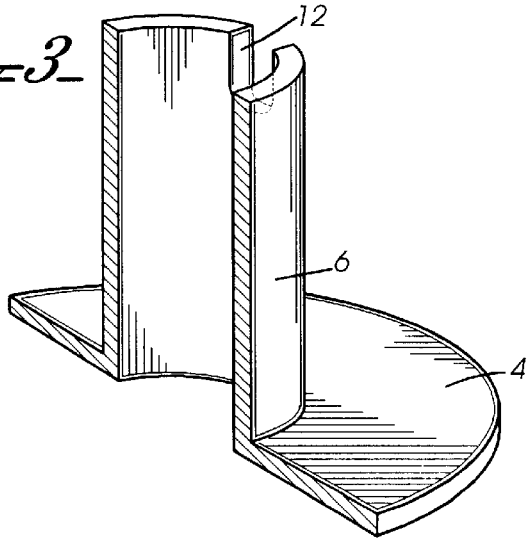
Fig 4
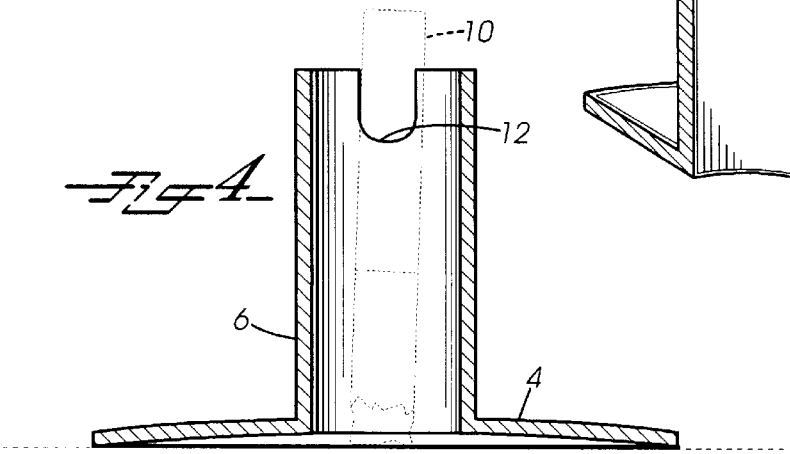

CIGARETTE SNUFFING DEVICE AND METHOD

BACKGROUND OF THE INVENTION

1. Field of the Invention

The present invention relates generally to cigarette and cigar snuffing devices. More specifically, the present invention is a free standing, portable, self cleaning cigarette extinguisher, including a circular base member having a hole in the center, and a cylindrical tube having an open upper end and an open lower end attached to the base member.

2. Discussion of the Prior Art

MARSHALL U.S. Pat. No. 4,473,084

O'DELL U.S. Pat. No. 4,497,329

EASTRIDGE, et al. U.S. Pat. No. 4,516,587

TIPPER U.S. Pat. No. 4,587,980

TAYLOR U.S. Pat. No. 5,345,953

CARDENAS U.S. Pat. No. 5,564,443

TAYLOR, CARDENAS and TIPPER teach cigarette snuffers having a cylindrical tube with an open end and a closed end used to extinguish a cigarette. O'DELL and EASTRIDGE disclose cigarette extinguishers including a housing having an axial bore therein and ridges around the axial bore to compress the lit end of the cigarette, in order to snuff the cigarette without crushing it. The present invention is lightweight, portable, easily cleaned and does not rely on internal ridges or compression of the cigarette for extinguishment. Further, none of the prior art includes grooves to hold a cigarette while it is burning and the smoker is otherwise occupied.

SUMMARY OF THE INVENTION

Accordingly, it is an important object of the present invention to provide a cigarette snuffing device which is portable, lightweight, easily cleaned and inexpensively manufactured.

Another object of the present invention is to provide a new and improved cigarette extinguishing device which overcomes some of the problems and disadvantages of the prior art.

Another object of the present invention is to provide a cigarette snuffing device that extinguishes the cigarette without crushing or otherwise dismembering it, so that it may be relit later at a more convenient time.

Yet another important object of the invention is to provide a cigarette extinguisher that can efficiently snuff out a cigarette, and also hold a burning cigarette while a smoker is otherwise occupied.

A further object of the invention is to provide a cigarette extinguisher that can be used in conjunction with an ash tray or on any inflammable surface.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view of the cigarette snuffing device positioned within an ash tray and holding a lit cigarette within the opposed grooves at the top of the cylindrical tube throat member;

FIG. 2 is a cross sectional view along the lines 2—2, showing a cigarette in the extinguishment position within the throat member with the burned end of the cigarette located adjacent the flat base member of the cigarette snuffer;

FIG. 3 is a perspective cross section along the line 2—2;

FIG. 4 is a cross sectional view of an alternate embodiment, wherein the base member is substantially convex shaped, so that the centrally located opening defined by the base member is raised slightly above the outer rim of the base member;

FIG. 5 is a top view of the cigarette snuffing device showing a cigarette in the upright extinguishment position.

DESCRIPTION OF THE PREFERRED EMBODIMENT

FIG. 1 illustrates a cigar and cigarette snuffing device, generally shown at 2, having a round base member 4 and a cylindrical throat member 6 attached thereto. The snuffing device is positioned within an ash tray 8, and is shown holding a cigarette 10 between a pair of opposed grooves 12 at the top of the throat member. When used for cigarette extinguishment, the snuffing device is placed into an ash tray as shown, and a lit cigarette is placed into the throat member with the lit end oriented downwardly within the throat. After a brief period of time, the cigarette is extinguished due to a lack of oxygen present within the lower portion of the throat member. Although the cylindrical throat member has an inner diameter that is substantially larger than the diameter of a standard cigarette, the oxygen level in the lower portion of the throat member drops enough to efficiently snuff out the cigarette.

FIG. 2 is a cross sectional view along the line 2—2, showing the cigarette in the extinguished position. The cylindrical throat member is shown with an open upper end and an open lower end, with the base member attached thereto. A centrally located hole defined within the base member communicates with the open lower end of the throat member, so that a cigarette placed into an extinguished position comes directly into contact with the floor of an ash tray. This arrangement allows a user to place the snuffing device into an ash tray, extinguish the cigarette, and remove the snuffing device without the accompanying ashes, which are left in the ash tray. Blowing through either end of the cylindrical throat member serves to clean out any remaining ashes, although this blowing step should not be necessary for removal of ashes.

FIG. 3 is a perspective cross section showing the opening defined by the base member in communication with the lower opening in the throat member. The groove shown at the top of the throat member is one of two opposed grooves (the other groove is not shown) used to secure a cigarette in a horizontal position while the smoker is otherwise occupied.

FIG. 4 is a cross sectional view of an alternate embodiment, wherein the base member is not flat, but is substantially convex shaped, similar to a contact lens. The outer rim portion of the base member rests on the floor of an ash tray, while the centrally located opening defined by the base member is raised slightly above the floor of the ash tray. This embodiment allows base member to more closely conform to the convex floor shape of many common ashtrays. Although the base member has thus far been described as if it were rigid, the base member could be made from any suitable flexible, non-flammable material so that it could conform to any of a variety of ash tray floor shapes.

The cigarette snuffing device is shown in FIG. 5 from a top view, illustrating a cigarette in the extinguishment position. It can be seen in FIG. 5 that the opening in the top of the throat member extends completely through the apparatus, so that when the cigarette snuffing device is placed into an ash tray, the lit end of the cigarette in the extinguishment position is in direct contact with the ash tray floor. Although the cigarette snuffing device has been described as being used in conjunction with an ash tray, it is to be understood that the device could be used in other ways. For instance, the cigarette snuffing device could be used at the beach, where it is simply placed into the sand in an upright position and used as previously described. In a preferred embodiment, the base member and the throat member are made of copper. Furthermore, the snuffing device could be used not only for standard cigarettes, but for cigars, filterless cigarettes, or cigarettes rolled by the smoker.

Another advantage offered by the present invention is that a cigarette which has been extinguished using this device not only stays intact and uncrushed, but it will not have any of the tar or ash accumulated on the sides if the smoker wants to relight the cigarette at a more convenient time. The cigarette snuffing device may be used in homes, offices, restaurants or automobiles.

While a preferred embodiment of the invention has been described using specific terms, such description is for illustrative purposes only, and it is to be understood that changes and variations may be made without departing from the spirit or scope of the following claims.

What is claimed is:

1. A cigarette and cigar snuffing device for use in an ash tray or the like, said snuffing device comprising:

a base member having an outer rim and a centrally located opening defined therein;

a vertical cylindrical throat member positioned about said opening defined by said base member, said throat member having an upper portion and a lower portion;

said upper portion of said throat member defining an opening for receiving a lit end of a cigarette or cigar, and said upper portion of said throat member defining a pair of opposed grooves so that a cigarette or cigar may be placed and secured horizontally across said upper portion of said throat member within said grooves; and said lower portion of said throat member defining an opening that communicates with said opening defined by said base member.

2. The structure set forth in claim 1, wherein said base member is substantially flat.

3. The structure set forth in claim 1, wherein said base member is a substantially convex shape so that said centrally located opening defined therein is raised slightly above said outer rim.

4. The structure set forth in claim 1, wherein said base member is made of a flexible material so that said base member may conform to a variety of ash tray surfaces.

5. The structure set forth in claim 1, wherein said snuffing device is made of copper.

6. A method of extinguishing a cigarette or cigar, said method comprising the steps of:

providing a base member having a centrally located opening defined therein;

providing a vertical cylindrical throat member having an open upper end and an open lower end positioned about said opening defined by said base member, so that said open lower end of said throat member communicates with said opening defined by said base member, and wherein said upper end defines a pair of opposed grooves for holding a cigarette or cigar in a vertical position;

placing said base and throat assembly onto a nonflammable surface;

placing the lit end of a cigarette through said upper end opening of said throat, through said lower end opening, and through said opening defined by said base member, so that the lit end of said cigarette is in direct contact with said nonflammable surface.

7. The method set forth in claim 6, wherein the nonflammable surface is the floor of an ash tray.

* * * * *